US006011947A

United States Patent [19]

Acquaviva et al.

[11] Patent Number: 6,011,947

[45] **Date of Patent: *Jan. 4, 2000**

[54] APPARATUS AND METHOD FOR AUTOMATICALLY ADJUSTING WATER FILM THICKNESS ON CONDITIONER METERING ROLLS

[75] Inventors: Thomas Acquaviva; Jack G. Elliot, both of Penfield, N.Y.

[73] Assignee: Xerox Corporation, Stamford, Conn.

[ * ] Notice: This patent is subject to a terminal disclaimer.

[21] Appl. No.: 08/939,361

[22] Filed: Sep. 29, 1997

[51] Int. Cl.[7] ..... G03G 15/00

[52] U.S. Cl. ..... 399/341; 399/406

[58] Field of Search ..... 399/341, 406, 399/411; 162/197, 270

[56] References Cited

U.S. PATENT DOCUMENTS 5,264,899 11/1993 Mandel ..... 399/341
5,434,029 7/1995 Moser ..... 430/97
5,832,359 11/1998 Acquaviva ..... 399/406
5,842,105 11/1998 Acquaviva ..... 399/406
5,850,589 12/1998 Cruz et al. ..... 399/341

*Primary Examiner*—William J. Royer
*Attorney, Agent, or Firm*—W. A. Henry, II

[57] ABSTRACT

A device and method for automatically adjusting conditioner metering roll liquid film thickness. The device including a transfer roll that mates with a back-up roll to form a nip through which a sheet passes for wetting a side of the sheet. A metering roll mates with the transfer roll and has a portion thereof positioned in a liquid filled sump for liquid to be added to an outside surface thereof. An optical sensor is positioned to detect the type of reflected light from the liquid on the outside surface of the metering roll and gives off a signal that is received by a controller that actuates a stepper motor to move the metering roll in a predetermined direction until the correct liquid thickness is obtained on the surface of the metering roll.

18 Claims, 2 Drawing Sheets

APPARATUS AND METHOD FOR AUTOMATICALLY ADJUSTING WATER FILM THICKNESS ON CONDITIONER METERING ROLLS

BACKGROUND OF THE INVENTION

Cross reference is hereby made to and commonly assigned U.S. application Ser. No. 08/939,895, entitled Apparatus and Method for Sensing Water Film Thickness on Conditioner Rolls, by Thomas Acquaviva, and and commonly assigned U.S. application Ser. No. 08/808,412, filed Feb. 28, 1997, and entitled Paper Conditioner with Articulating Back-up/Transfer Rollers, by Thomas Acquaviva et al.

FIELD OF THE INVENTION

This invention relates generally to a substrate conditioning device for an electrophotographic printing machine and, more particularly, concerns an apparatus and method for automatically adjusting the thickness of liquid on a metering roll in the substrate conditioning device.

DESCRIPTION OF PRIOR ART

In typical multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal. This causes different moisture evaporation from the two sides of the sheet and contributes to sheet curling.

Paper curl is defined as any deviation from it's flat state. In the xerographic process, fusing drives moisture out. When regaining moisture, paper experiences curl due to differential hygroexpansitivity and thermoexpansivity between the paper and toner, and dimensional instability of paper due to its moisture history. The paper expands due to moisture reabsorption, but the toner does not expand, thus developing curl. Paper curl is one of the primary causes for paper handling problems in copying machines. Problems, such as, stubbing, image deletions and improper stacking result from copy sheet curl. These problems are more severe for color copies than black and white due to differences in their toner mass area, substrates, and fuser characteristics.

The following disclosures may be relevant to various aspects of the present invention:

U.S. Pat. No. 5,264,899

Patentee: Mandel

Issued: Nov. 23, 1993

U.S. Pat. No. 5,434,029

Inventor: Moser

Issue Date: Jul. 18, 1995

Portions of the foregoing disclosures may be briefly summarized as follows:

U.S. Pat. No. 5,264,899 describes a system for adding moisture to a copy sheet. The toner fixation step of electrostatographic reproduction desiccates paper, which may lead to the formation of a wave along the sheet edge. The invention uses a pair of porous rolls defining a nip to transfer additional moisture to the copy sheet as it is passed through the nip. The added moisture prevents edge wave formation.

U.S. Pat. No. 5,434,029 describes an apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aforementioned nip.

There remains a need for a system for preventing curl caused by the loss of moisture from a copy sheet during the fixing step of electrostatographic reproduction or printing that is practical for use with electrostatographic machines and is non-subjective in indicating when the correct water thickness is obtained on metering rolls. Ordinarily, the film thickness on a transfer roll is set-up by adjusting the interference between a rubber metering roll and the transfer roll and observing the sheen on the metering roll. When the correct water thickness is obtained, the surface appearance on the black rubber metering roll changes from a gloss to a matte-like finish. Currently, the only way to make this adjustment is by eye, i.e., observe the appearance of the metering roll. This procedure is not acceptable for customer machine set-up or in manufacturing.

SUMMARY OF THE INVENTION

Accordingly, there is provided a device for automatically adjusting the amounts of moisture to a metering roll. The device comprising at least one transfer roll that mates with at least one back-up roll to form a nip through which a sheet passes for wetting a sheet. A metering roll mates with the at least one transfer roll and has a portion thereof positioned in a liquid filled sump for liquid to be added to an outside surface thereof. An optical sensor is positioned to detect the type of reflected light from the liquid on the outside surface of the metering roll and is used in conjunction with a controller to actuate a stepper motor that is connected to the metering roll to automatically position the metering roll with respect to the transfer roll until the correct film thickness is obtained.

In accordance with another aspect of the invention there is provided a system for fixing a toner image to a copy sheet in an electrophotographic system so as to avoid the formation of copy sheet curl. The system comprising first and second fusing rollers defining a nip therebetween, at least one of said fusing rollers being heated, wherein the fusing rollers serve to fix a toner image on a copy sheet through the application of heat and pressure to the copy sheet; a conditioning system for receiving a copy sheet from said fusing rollers and automatically adjusting liquid film thickness on metering rolls, comprising; a transfer roll and a back-up roll positioned with respect to each other so that they form a nip therebetween when a sheet is present therein; a metering roll that mates with said transfer roll to form a nip therebetween, said metering roll having a portion thereof positioned within a liquid filled sump for liquid to be added to an outside surface thereof; and an optical sensor that detects the type of reflected light from the liquid on the outside surface of the metering roll; a controller for receiving the signal from said sensor and actuating a stepper motor to move said metering roll towards said transfer roll until a predetermined thickness of liquid on the surface of the metering roll is obtained.

In accordance with yet another aspect of the invention there is provided a method for sensing liquid film thickness on a conditioner metering roll. The method comprising the steps of: providing a reservoir of liquid; positioning a black rubber metering roll with respect to the reservoir such that rotation of the metering roll places liquid from the reservoir onto a longitudinal outside surface of the metering roll; positioning a transfer roll having a longitudinal outside surface with respect to the metering roll such that a nip is formed between the rolls when a sheet is passing therethrough; positioning at least one optical sensor adjacent the longitudinal outside surface of the metering roll; sensing the thickness of liquid on the longitudinal surface of the metering roll with the optical sensor; and controlling the spacing between said metering roll and said transfer roll in order to thereby control the thickness of liquid on said outside surface of said metering roll.

BRIEF DESCRIPTION OF THE DRAWINGS

Other features of the present invention will become apparent as the following description proceeds and upon reference to the drawings, in which.

DETAILED DESCRIPTION OF THE INVENTION

This invention relates to an imaging system which is used to produce color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Figure 1:
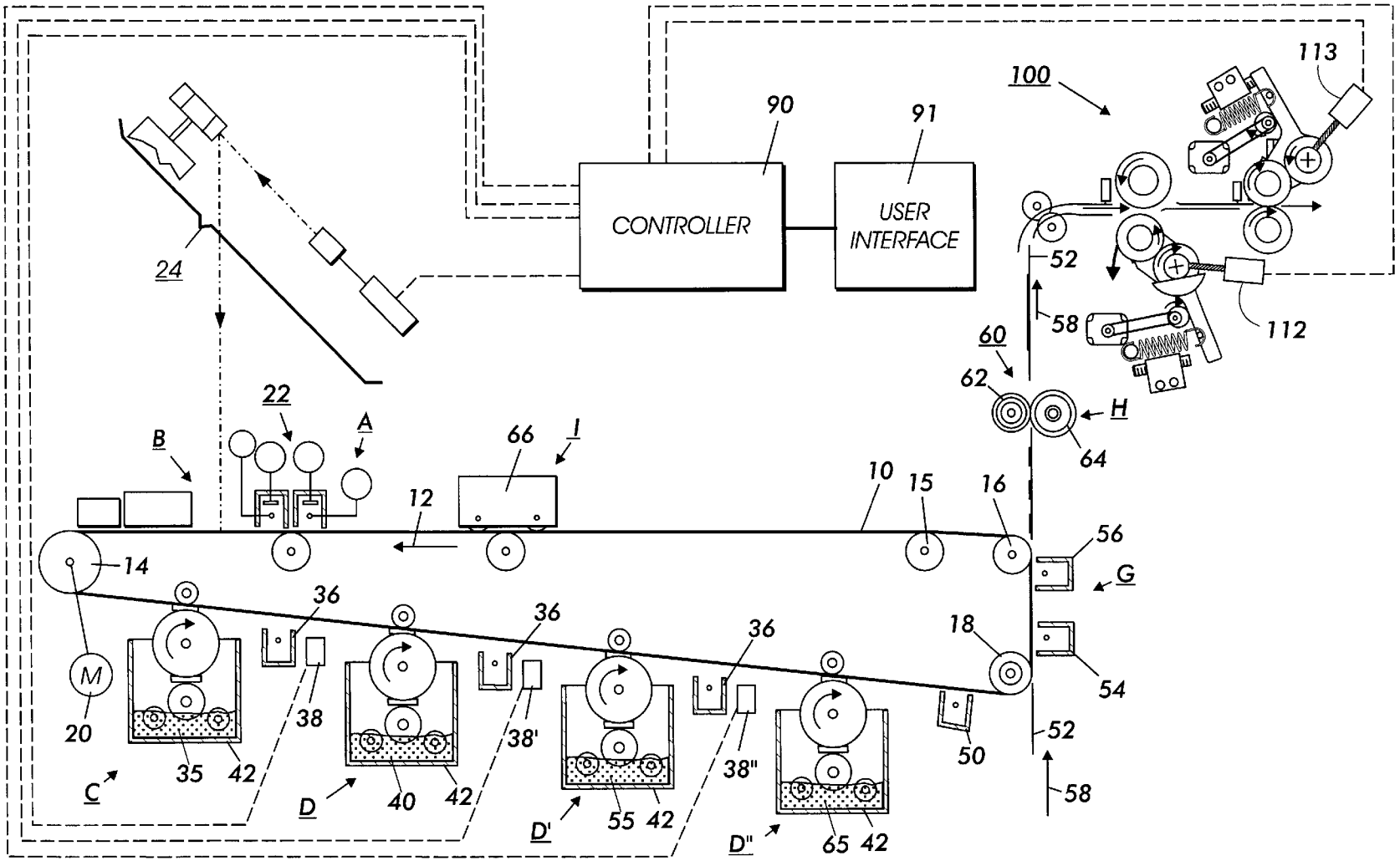
FIG. 1 is a schematic elevational view of a full color image-on-image single pass electrophotographic printing machine utilizing the sheet conditioning device with automatic metering roll liquid film thickness described herein.

Turning now in general to FIG. 1, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, idler roll 15, tension roller 16 and fixed roller 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of the photoconductive surface is advanced through an imaging/exposure station B. At imaging/exposure station B, a controller, indicated generally by reference numeral 90, receives the image signals representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the imaging/exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C which contains black toner 35, developer structure, indicated generally by the reference numeral 42 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a non-contact type in which only toner particles (black, for example) are attracted to the latent image and there is no mechanical contact between the photoreceptor and a toner delivery device to disturb a previously developed, but unfixed, image.

A corona recharge device 36 having a high output current vs. control surface voltage (I/V) characteristic slope is employed for raising the voltage level of both the toned and untoned areas on the photoreceptor to a substantially uniform level. The recharging device 36 serves to recharge the photoreceptor to a predetermined level.

A second imaging/exposure device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third imager for a third suitable color toner 55, such as, magenta and for a fourth imager and suitable color toner 65, such as, cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack copy sheets in a tray. The feed roll rotates so as to advance the uppermost sheet from the stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to sheet moisture replacement system 100 and then to a catch tray, not shown, for subsequent removal from the printing machine by the operator.

After the sheet of support material is separated from the photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 2:
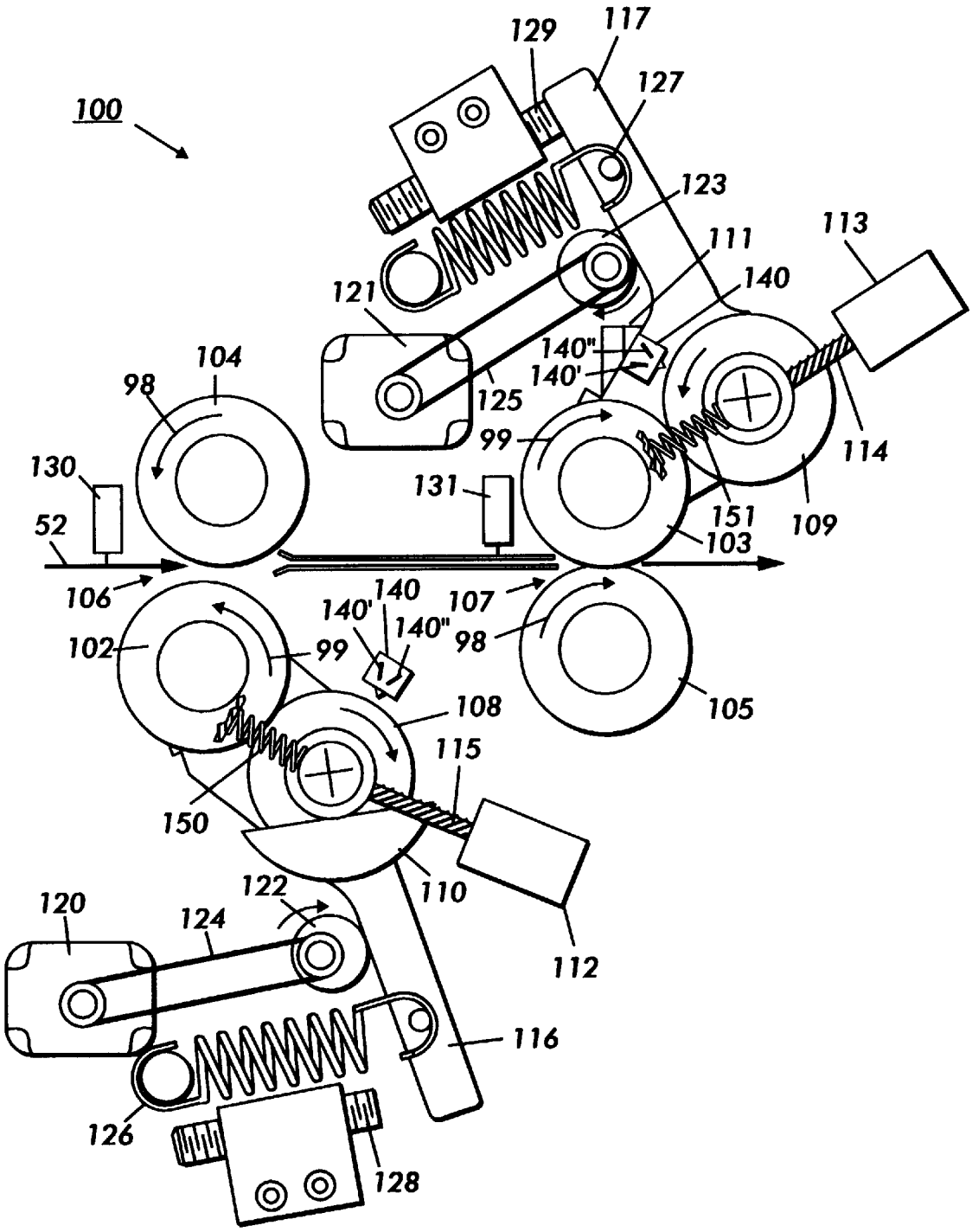
FIG. 2 is a detailed elevational side view of the sheet conditioning device of FIG. 1.

As shown in FIG. 2, the sheet moisture replacement system or sheet conditioning device, generally referred to as reference numeral 100, has hydrophilic transfer rollers 102, 103 which are articulated in an almost vertical direction, such that when the lead edge of incoming sheets 52 enter the nip areas 106, 107, the transfer rollers 102, 103 move towards the sheet 52 to engage the rotating back-up rollers 104, 105 which rotate in the direction of arrow 98 and are in a fixed position. Likewise, when the trail edge of the sheet is about to exit the nips 106, 107, the transfer rollers 102, 103 move away from the sheet 52 to disengage the back-up rollers 104, 105. Springs 126, 127 provide the normal force for the transfer rollers 102, 103 against back-up rollers 104, 105. Since the back-up rollers 104, 105 are rubber coated, a thick or thin sheet will deflect the rubber surface and springs and provide the necessary drive force. The roller nips 106, 107 are disengaged in the intercopy gap, by say 0.015", and there is no danger that the back-up rollers 104, 105 will be wet.

The wetting agent, in this case water, is distributed to the transfer rollers 102, 103 from sumps 110, 111 by way of metering rolls 108, 109. The sump 111 must be modified for the upper transfer roll 103/metering roll 109 assembly so that the wetting agent is prevented from dripping onto the sheet and producing undesireable wetting characteristics. This can be accomplished by utilizing a liquid dam in combination with the upper metering roll 109 to provide a flooded nip. The amount of moisture added to a sheet is a function of the relative velocity between the sheet 52 and the transfer rollers 102, 103, which transfer rollers 102, 103 are rotated in a direction opposite to the direction of the sheet as indicated by arrows 99.

A sensor 130 located upstream of the first moisturizing nip 106, detects lead and trail edge sheet position and provides the necessary timing to close and open the nips 106, 107. For example, if the sheet velocity when it is at the sensor 130, and the distance from the sensor 130 to each moisturizing nip 106, 107 are known, and the velocity between nips and sheet velocity in each nip is known, then it is a relatively simple algorithm to determine when to engage and disengage each nip. Alternately, a second sensor 131 can be used between the nips 106, 107 to assist in determining the proper sequencing of the nip engagement/disengagement.

There is illustrated only one of many methods of separating the nips 106, 107. In FIG. 2, there is shown two stepper motors 120, 121 driving two cams 122, 123. As each cam 122, 123 rotates in the clockwise direction, it separates the respective transfer roller 102, 103 from the respective back-up roller 104, 105. In the position illustrated by the cam 122, and pivot arm 116 the nip 106 may be separated by 0.015". When the cams are in the position illustrated by cam 123, the cam surface is not touching the pivot arm 117, but the contact dimension is determined by the adjustment screw 129. A similar screw 128 is provided for arm 116. This scheme uses two stepper motors 120, 121 driving cams 122, 123 through drive members 124, 125. Alternate methods might employ solenoids, clutches, cables etc. Likewise, alternate methods might articulate the back-up rollers 104, 105 instead of the transfer rollers 102, 103.

In accordance with the present invention, the contact between the metering rolls 108 and 109 and the transfer rolls 102 and 103 is automatically adjusted by positioning the metering rolls 108 and 109 with stepper motors 112 and 113 based on signals received by controller 90 from sensors 140 depending on the desired film thickness on the metering.

Sensors 140 are preferably optical sensors that include an input 140' and an output 140". Preferably, two optical sensors 140 are used on each of metering rolls 108 and 109 to indicate water film thickness. The two sensors are located opposite each end of metering rolls 108 and 109. The sensors are connected to controller 90 and are positioned with respect to the outer surface of metering rolls 108 and 109 such that the incident angle of light reflects off the surface of the metering rolls. Sensors 140 are conventional and consist of a pulsed infrared light emitting diode 140' and a phototransistor 140". A light beam from 140' is directed at the surface of the rotating metering rolls 108 and 109. When the water film is thick, i.e., the metering roll is not touching the transfer roll, the surface of each metering roll 108 and 109 is glossy and the light beam is reflected into output 140". When the transfer and metering rolls touch, and the water film is thin, the surface of the metering roll takes on a matte-like appearance, and the light beam scatters after leaving the roll surface. Hence, only a minute amount of light would arrive at sensor output 140".

In use of the fully automated metering roll/transfer roll set-up procedure in accordance with the present invention, metering rolls 108 and 109 are initially separated from transfer rolls 102 and 103 through controller 90 actuating stepper motors 112 and 113 and springs 150 and 151 to drive adjusting screws 114 and 115 on each end of the metering rolls backward by some amount, for example, 0.020".Stepper motors 112 and 113 would then change direction and the metering rolls would then slowly drive toward the transfer rolls and compression springs 150 and 151 while the sensors detect the film thickness on either end of the metering rolls. Once the matte surface is detected, this condition would be displayed on user interface (UI) 91, but the stepper motors would continue to drive the adjusting screws an additional number of steps corresponding to about 0.008" of roller interference. A signal will be displayed in the UI 91 that the set-up routine has been completed.

In recapitulation, a conditioner adds a small amount of water to sheets in order to control sheet curl. The conditioner includes a procedure to automatically set-up metering/transfer roll water film thickness by using a diagnostic routine which takes out any subjectivity on the part of an operator. The procedure uses an optical sensor to detect the type of reflected light from the water surface on the metering roll. With a signal from the sensor, a controller actuates stepper motors that automatically adjust the spacing between the metering rolls and transfer rolls until the desired water thickness on the outer surface of the metering rolls have been reached.

It is, therefore, apparent that there has been provided in accordance with the present invention, a paper conditioning device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A device for automatically adjusting thickness of liquid on a metering roll, comprising:

a transfer roll that mates with a back-up roll to form a nip when a sheet passes therethrough for wetting a side of the sheet;

a metering roll positioned to form a nip with said transfer roll;

a liquid filled sump, said metering roll including a portion thereof positioned within said liquid filled sump for adding liquid to an outer surface thereof;

an optical sensor positioned to detect a type of reflected light from the liquid on said outer surface of said metering roll and send a signal indicative of the same;

a stepper motor connected to said metering roll to adjust said metering roll position in either of two directions; and a controller that receives said signal from said sensor and in turn actuates said stepper motor to adjust a said metering roll in one of said two directions.

2. The device of claim 1, including plurality of transfer and metering rolls.

3. The device of claim 2, wherein said optical sensor is positioned on a metered side of said metering rolls.

4. The device of claim 3, wherein said transfer rolls rotate in a counterclockwise direction.

5. The device of claim 4 wherein said back-up roll rotates in a counterclockwise direction.

6. The device of claim 5, wherein said metering roll rotates in a clockwise direction.

7. The device of claim 6, wherein said transfer rolls are hydrophilic.

8. The device of claim 7, wherein said metering rolls are rubber coated.

9. The device of claim 8, wherein the rubber coating on said metering rolls is black.

10. The device of claim 1, wherein said transfer roll rotate in a direction opposite to a sheet feeding direction.

11. A system for fixing a toner image to a copy sheet in an electrophotographic system so as to avoid the formation of copy sheet curl while automatically adjusting metering roll water film thickness, comprising:

first and second fusing rollers defining a nip therebetween, at least one of said fusing rollers being heated, wherein the fusing rollers serve to fix a toner image on a copy sheet through the application of heat and pressure to the copy sheet; and a conditioning system for receiving a copy sheet from said fusing rollers, comprising; a transfer roll and a back-up roll positioned with respect to each other to form a nip therebetween when a sheet is present therein; a metering roll positioned to mate with said transfer roll to form a nip therebetween, said metering roll having a portion thereof positioned within a liquid filled sump for liquid to be added to an outside surface thereof; an optical sensor detects a type of reflected light from the liquid on said outside surface of said metering roll and gives off a signal indicating contact between said transfer roll and said metering roll; a stepper motor connected to said metering roll to adjust said metering roll position in either of two directions; and a controller that receives said signal from said sensor and in turn actuates said stepper motor to adjust said metering roll in one of said two directions until the proper water film thickness on said metering roll has been obtained.

12. The system of claim 11, wherein said transfer roll rotates in a counterclockwise direction.

13. The system of claim 12, wherein said back-up rolls rotates in a counterclockwise direction.

14. The system of claim 13, wherein said metering roll rotates in a clockwise direction.

15. The system of claim 14, wherein said transfer roll is hydrophilic.

16. The system of claim 15, wherein said metering roll is coated with black rubber.

17. A method for automatically setting liquid film thickness on an outside surface of a metering roll, comprising the steps of: providing a reservoir of liquid;

positioning a black rubber metering roll with respect to the reservoir such that rotation of the metering roll places liquid from the reservoir onto a longitudinal outside surface of the metering roll;

positioning a transfer roll having a longitudinal outside surface with respect to said metering roll such that a nip is formed therebetween;

positioning at least one optical sensor adjacent said longitudinal outside surface of said metering roll; and sensing the thickness of liquid on said longitudinal surface of said metering roll with said at least one optical sensor;

providing a stepper motor connected to said metering roll to adjust said metering roll in either of two directions; and providing a controller that receives said signal from said at least one optical sensor and in turn actuates said stepper motor to adjust said metering roll in one of said two directions.

18. A device that automatically adjusts a conditioner metering roll liquid film thickness, comprising:

a reservoir for storing a quantity of liquid;

a pair of generally cylindrical rolls, each having an outer cylindrical surface, said rolls being aligned with respect to one another along their axes so as to define a nip between said outer cylindrical surfaces;

a metering roll in circumferential surface contact with one of said rolls for controlling the flow of liquid from the reservoir to at least one of said rolls;

a selectively actuable support mechanism to separate and engage said rolls based upon the location of a sheet;

an optical sensor positioned to detect a type of reflected light from liquid on an outer surface of said metering roll and send a signal indicative of the same;

a stepper motor connected to said metering, roll to adjust said metering roll in either of two directions; and a controller that receives said signal from said optical sensor and in turn actuates said stepper motor to adjust said metering roll in one of said two directions in order to control liquid film thickness on said outer surface of said metering roll.

* * * * *